US005818516A

United States Patent [19]

Rezanka

[11] Patent Number: 5,818,516

[45] Date of Patent: Oct. 6, 1998

[54] INK JET CARTRIDGE HAVING IMPROVED HEAT MANAGEMENT

[75] Inventor: Ivan Rezanka, Pittsford, N.Y.

[73] Assignee: Xerox Corporation, Stamford, Conn.

[21] Appl. No.: 897,647

[22] Filed: Jul. 21, 1997

[51] Int. Cl.[6] ..... B41J 2/05; B41J 2/175

[52] U.S. Cl. ..... 347/18; 347/65

[58] Field of Search ..... 347/63, 65, 87, 347/18

[56] References Cited

U.S. PATENT DOCUMENTS

| | | | |
|---|---|---|---|
| 4,638,337 | 1/1987 | Torpey et al. | 346/140 |
| 4,774,530 | 9/1988 | Hawkins | 346/140 |
| 4,789,425 | 12/1988 | Drake et al. | 156/644 |
| 4,831,390 | 5/1989 | Deshpande et al. | 346/140 |
| 5,017,941 | 5/1991 | Drake | 346/1.1 |
| 5,066,964 | 11/1991 | Fukuda et al. | 347/18 |
| 5,121,130 | 6/1992 | Hempel et al. | 346/1.1 |
| 5,216,446 | 6/1993 | Satoi et al. | 347/18 |
| 5,519,425 | 5/1996 | Dietl et al. | 347/87 |
| 5,552,816 | 9/1996 | Oda et al. | 347/86 |

FOREIGN PATENT DOCUMENTS 4-241952 8/1992 Japan .

*Primary Examiner*—Edgar S. Burr
*Assistant Examiner*—Daniel J. Colilla

[57] ABSTRACT

An ink cartridge for use in a thermal ink jet printer has a printhead with an edgeshooter configuration and improved heat management. The cartridge has a supply of ink in a chamber and a passageway for placing the chamber in fluid communication with the printhead. The printhead has an array of heating elements, one in each of a plurality of ink channels, and located a predetermined distance from the channel opens which serve as nozzles. The passageway directs the ink in a path closely adjacent the heating elements, so that more of the waste heat generated by the heating elements are transferred to the ink prior to entry of the ink into the channels, thereby resulting in more waste heat being carried away by the ejected ink droplets.

4 Claims, 4 Drawing Sheets

INK JET CARTRIDGE HAVING IMPROVED HEAT MANAGEMENT

BACKGROUND OF THE INVENTION

The invention relates to ink jet printing systems and more particularly to replaceable ink cartridges having improved heat management for use in thermal ink jet printers.

Thermal ink jet printing is generally a droplet-on-demand type of ink jet printing which uses thermal energy to produce momentary vapor bubbles in an ink filled channel to expel droplets of ink one at a time. A thermal energy generator or heating element, usually a resistor, is located in the channels of a printhead near the nozzles and are individually addressed with an electrical pulse to form almost instantaneously the droplet ejecting momentary vapor bubble which is then quickly allowed to collapse. Within milliseconds the ink at the nozzle is hydrodynamically dampened and ready for the ejection of another ink droplet.

There are basically two different printhead design configurations for droplet-on-demand thermal ink jet printers; viz., roofshooters and edgeshooters. For a roofshooter type thermal ink jet printhead, the printhead nozzles are aligned directly over the heating elements and parallel therewith, so that the ejected ink droplets follow a trajectory substantially normal to the heating element. For more information about a typical roofshooter type printhead, refer to U.S. Pat. No. 4,789,425. For an edgeshooter type of printhead, the heating element is located in an ink filled channel a predetermined distance upstream from the nozzle which is oriented substantially perpendicular to the heating element, so that the trajectory of the ejected ink droplet is about parallel with the surface of the heating element. The nozzles are usually in the edge of the printhead, and hence the name 'edge shooter.' For a discussion of a typical edge shooter type printhead, refer to U.S. Pat. No. 4,774,530, which patent is incorporated herein by reference.

It is well known that print quality is affected as the thermal ink jet printhead heats up during use, especially for extended high density printing, which may be referred to as high duty cycle printing. If the printhead heats up beyond its intended temperature range it could lose prime and fail. A less catastrophic defect, but still one that degrades print quality, is when the printhead ejects droplets which vary in size because of unwanted printhead temperature fluctuations. Many known printheads incorporate a heat sink of sufficient mass and thermal resistance to prevent the printhead temperature from rising excessively. For an example of a thermal ink jet printhead having a heat sink, refer to U.S. Pat. No. 4,831,390.

U.S. Pat. No. 5,017,941 discloses a thermal ink jet printhead having a passageway for the circulation of a cooling fluid therethrough. The passageway is parallel to and closely adjacent the array of heating elements. In one embodiment, the passageway is formed from a groove in a sealing plate, the heater plate, or both.

U.S. Pat. No. 5,121,130 discloses a printhead assembly having a plurality of printheads mounted on a common heat sink. To prevent overheating of a printhead during periods of heavy use or high duty cycle printing, the ink supply path is through the heat sink to receive heat therefrom in a heat exchanger fashion and carry the heat away to a holding tank which supplies ink to the printheads.

U.S. patent application Ser. No. 08/754,906, entitled "Thermal Ink Jet Printing System With Continuous Ink Circulation Through A Printhead," filed Nov. 22, 1996 and assigned to the same assignee as the present invention discloses several embodiments of printheads in which a continuous ink path is established through the printheads by forming ink channels in various internal portions of the printheads. Ink is recirculated continuously through the printhead ink paths to prevent thickening or drying out of the ink at the nozzles during non-print periods.

SUMMARY OF THE INVENTION

It is an object of the present invention to improve the heat management of a thermal ink jet cartridge by increasing the waste heat carried away by the ejected ink droplets.

In one aspect of the invention, there is provided an ink cartridge having a supply of ink in a chamber and a printhead, the printhead having droplet ejecting heating elements located in channels a predetermined distance upstream from nozzles which are substantially perpendicular to the heating elements, the cartridge comprising: means for supplying ink from the chamber to the printhead channels by a passageway closely adjacent the heating elements, so that ink introduced into the channels in first passed by the heating elements, whereat waste heat is transferred to the ink prior to entering the ink channels, resulting in more waste heat being carried away by the ejected ink droplets.

In one embodiment of the invention, there is provided an ink cartridge for use in a thermal ink jet printer having improved heat management, comprising: a housing having a vented chamber containing ink and an ink outlet port; a printhead having a channel plate and a heater plate, the channel plate and heater plate each having first and second surfaces, the channel plate first surface having a recess and a plurality of grooves therein having opposing ends, one end of each of the grooves opening through an edge face of the channel plate, and the other end of the grooves being in communication with the channel plate recess, the heater plate first surface having a plurality of heating elements and addressing electrodes thereon, the heater plate second surface having a recess therein with a floor spaced a predetermined distance from the heater plate first surface, the floor having at least one aperture therein which opens through the heater plate first surface at a location adjacent, but spaced from one side of said plurality of heating elements and addressing electrodes, the channel plate and heater plate first surfaces being aligned and bonded together, so that the grooves and groove open ends form the printhead ink channels and nozzles, respectively, with each channel having a heating element therein located a predetermined distance from the nozzles, the channel plate recess forming an ink reservoir after being closed by the heater plate, and the aperture in the heater plate floor providing a communication path between the heater plate recess and the channel plate reservoir; a heat sink having first and second surfaces and being fixedly mounted on the housing, the heat sink having an internal cavity opening through the heat sink first surface and an inlet port connected to the cavity; said printhead being fixedly attached to the heat sink with the heater plate second surface residing against the heat sink first surface and the heater plate recess being aligned with the cavity opening of the heat sink; and means connecting the housing outlet port with the heat sink inlet port, whereby the ink is heated by the heating elements prior to entry into the reservoir, so that ink droplets ejected from said nozzles have increased temperature and thus carry away more waste heat.

BRIEF DESCRIPTION OF THE DRAWINGS

The present invention will now be described by way of example with reference to the accompanying drawings, in which like reference numerals refer to like elements, and wherein.

DESCRIPTION OF THE PREFERRED EMBODIMENT

Figure 1:
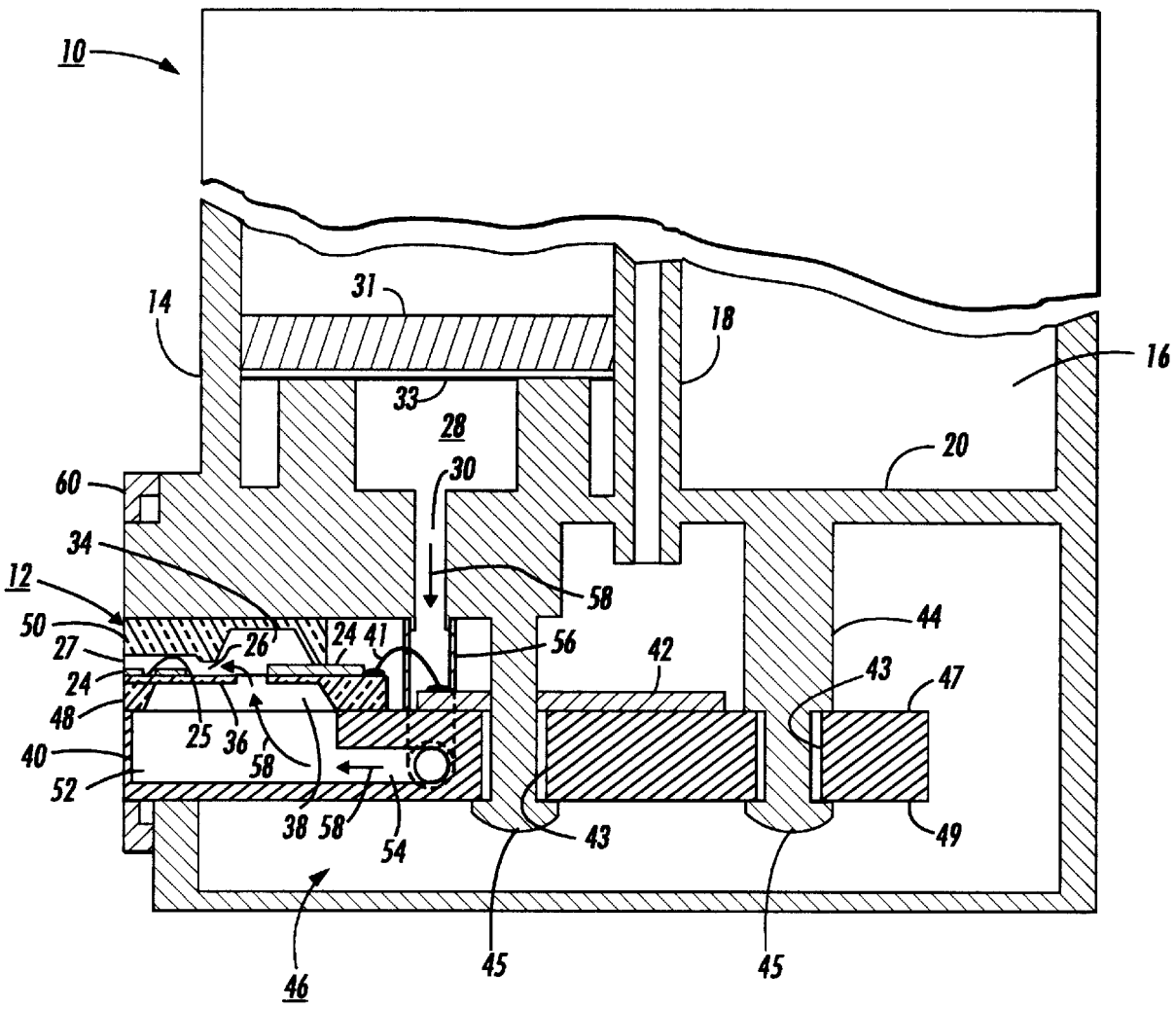
FIG. 1 is a schematic, partially shown and partially sectioned, side elevation view of an ink jet cartridge with integral printhead having the improved heat management of the present invention.

In FIG. 1, a disposable ink cartridge 10 with integral printhead 12 is shown that is similar to the cartridge disclosed in U.S. Pat. No. 5,519,425, which patent is incorporated herein by reference. The cartridge 10 comprises a housing 14 typically made of a lightweight, durable plastic which defines a chamber 16 for storing liquid ink in a first absorbent material (not shown) contained therein, such as, for example, a needled polyester felt. The chamber is hermetically sealed except for the sealed ink flow path to the printhead nozzles 27, discussed later, and a vent 18 that penetrates the chamber floor 20 and opens the chamber 16 to the atmosphere. A recess or well 28 is integrally formed in the chamber floor and contains an output port 30 from which ink is delivered to the printhead by means discussed later. A second absorbent member 31 sealingly covers the open end of the well 28 and has a capillary force greater than the first absorbent material. Optionally, a woven polyester filter 33 is sandwiched between the second absorbent member and the open end of the well 28.

The printhead 12 and a circuit board 42 are bonded to a heat sink 40 and are electrically connected by wire bonds 41 to form a printhead assembly 46 that is attached to the cartridge housing 14 by stake pins 44 which are integrally formed with the cartridge housing and which are inserted through alignment holes 43 in the heat sink. The stake pins are ultrasonically staked to form fastening heads 45 that fixedly attach the printhead assembly 46 to the cartridge.

Figure 2:
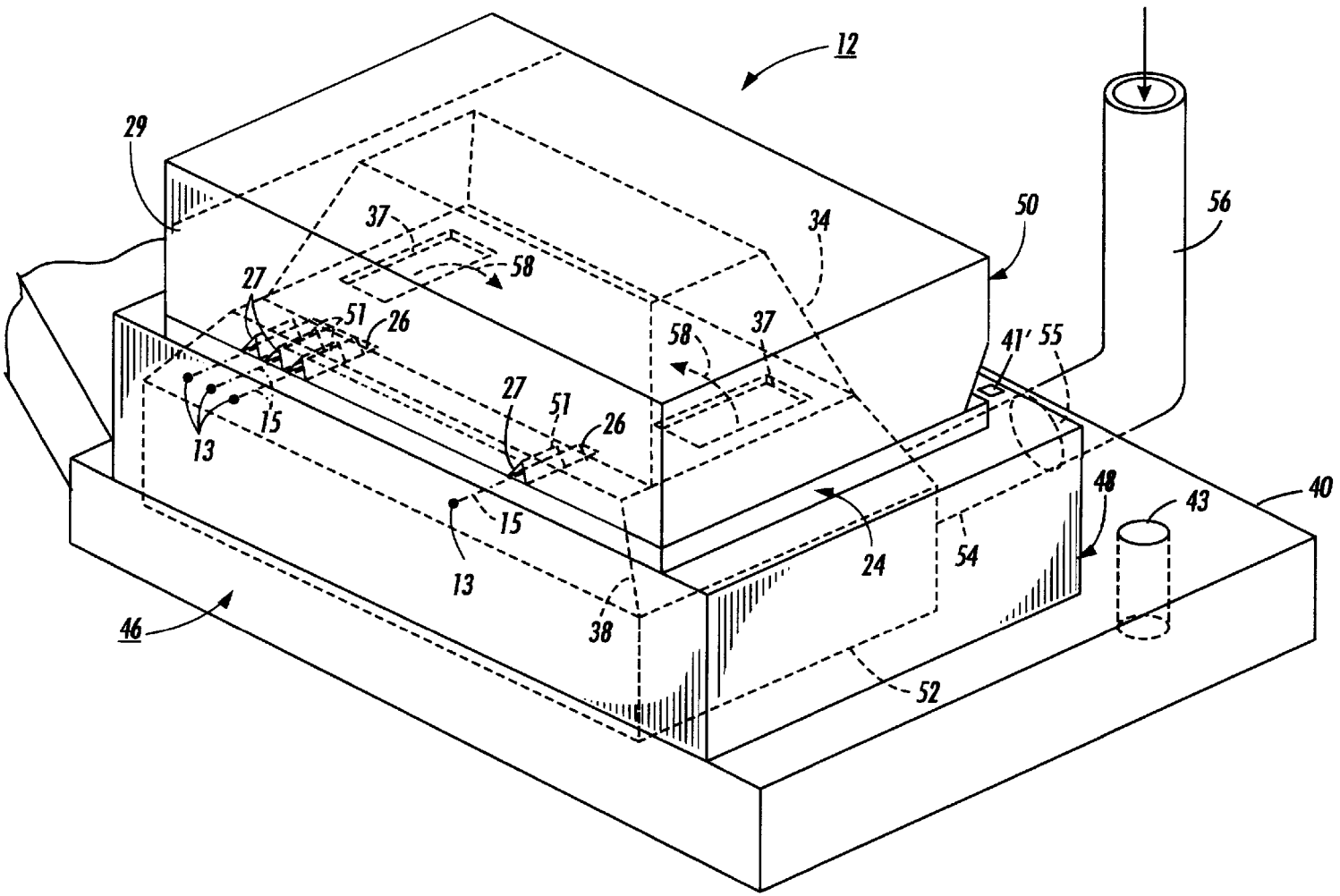
FIG. 2 is a schematic isometric view of the printhead shown in FIG. 1 in which the internal ink flow passageways and reservoirs are shown in dashed line.

An enlarged schematic isometric view of the printhead assembly 46 is shown in FIG. 2. Referring to both FIGS. 1 and 2, the printhead 12 comprises a heater plate 48 having heating elements and addressing electrodes (neither shown) and a channel plate 50 having a parallel array of channels 51 (shown in dashed line). One end of the channels 51 open through the printhead face 29 and serve as nozzles 27. The other end of the channels are in fluid communication with a reservoir 34 (shown in dashed line). As described in U.S. Pat. No. 4,774,530, the relevant portions of which are incorporated herein by reference, a patterned thick film insulative layer 24, such as, for example, polyimide, is sandwiched between the channel plate 50 and the heater plate 48. The thick film layer is patterned to provide access to the addressing electrode terminals for the wire bonds 41 and to expose the heating elements, thereby placing each of them in a pit 25. A trough or elongated recess 26 is provided in the thick film layer between the channels and the reservoir to enable an ink path therebetween.

As disclosed in U.S. Pat. No. 4,638,337, also incorporated herein by reference, a plurality of channel plates 50 is formed from a first silicon wafer (not shown) by photographically patterning on one surface thereof a plurality of sets of parallel grooves 51 and a recess 34 for each set of grooves. When bonded to the patterned thick film layer which covers the plurality of arrays of heating elements and addressing electrodes on the heater wafer, the grooves become the ink channels 51 and the recesses become the ink reservoirs 34. The bonded wafers are separated by a dicing operation to produce the plurality of separate printheads 12, one of which is used in the cartridge 10 of FIG. 1 and shown in isometric view in FIG. 2. The dicing operation produces the printhead face 29 and concurrently opens one end of the channels to produce the nozzles 27. The one difference between the channel plates of the present invention and the channel plates of the '337 patent is that the reservoirs in the channel plates of this invention do not have an ink inlet. Instead the ink enters the reservoir 34 from the heater plate 48 as described below.

The plurality of heater plates 48 are produced from a second silicon wafer in a manner similar to the process described in the '337 patent, but with the additional process steps of providing an etch stop on the surface of the silicon wafer which is to contain the heating elements and addressing electrodes and the etching of the opposite surface to produce a plurality of recesses 38 therein, one recess for each array of heating elements. Using a two-side polished, p-type (100) silicon wafer, one side is doped with a boron implant though a $SiO_2$ mask of posts (not shown) at predetermined locations to form a n-type layer having non-doped areas under the posts, which will subsequently provide etched-through apertures 37, at least one and preferably two for each array of heating elements. The heating elements will be subsequently patterned, so that the non-doped areas which will later become the apertures 37, are positioned at one side of the heating elements or, if there are two non-doped areas, they will be on opposite sides of each array of heating elements. The doped areas form an etch stop and have a concentration of about $10^{12}$ boron ions/cc and a depth of about 25 to 50 $\mu$m. The $SiO_2$ posts are removed and both sides of the wafer coated with an etch resistant mask, such as silicon nitride ($Si_3N_4$). The $Si_3N_4$ mask on the side of the wafer opposite the doped side is patterned to form vias (not shown) therein, one for each subsequently formed array of heating elements. The vias will enable the etching of a recess 38 and the via location is at a predetermined location, so that each recess 38 is beneath and at least partially aligned under each array of the subsequently to be formed heating elements. The interface of the doped n-type layer and p-type silicon produces a p-n junction which is electrically biased during the etching process in order to prevent etching of the n-type layer. Because the n-type layer is only lightly doped, a stress build up during the anisotropic etching for the production of the heater plate recesses 38 is substantially reduced. The anisotropic etching with an electrical bias is disclosed in more detail in U.S. application Ser. No. 08/805,834 entitled "A Method of Fabricating Ink Jet Printheads," filed Mar. 3, 1997 and assigned to the same assignee as the present invention, the relevant parts of which are incorporated herein by reference. A high doping level for a n-type layer having a concentration of $10^{19}$ to $10^{20}$ boron ions/cc requires no voltage potential to stop the etch, but it is the high doping levels which lead to high levels of internal stress, the result of which tends to cause cracks and reduce yield of heater plates.

Each heater plate recess 38 is anisotropically etched through the vias in the etch resistant mask with an electrical bias, so that the etch stop is the recess floor and each recess is located at least partially beneath a one of the subsequently formed arrays of heating elements. The non-doped areas are etched through the wafer to produce apertures 37, shown in FIG. 2. A plurality of sets of heating elements and their addressing electrodes are patterned on the doped surface of the silicon wafer with the apertures 37 at one side or both sides of each array of heating elements. Alternatively, the etch stop may cover the entire surface of the wafer and the apertures 37 through the etch stop may be obtained by a separate etching process, after the heating elements and addressing electrodes have been formed by means well known in the art. Next, the thick film layer 24 of polyimide is deposited on the surface of the second silicon wafer having the heating elements and addressing electrodes and patterned to expose the heating elements, thereby placing each of them in a pit 25, to expose the electrode terminals (not shown), and to remove the thick film layer 24 from the heater plate apertures 37 and the areas 26 which will provide a flow path between the reservoirs and the respective set of ink channels. Next, the first silicon wafer containing the sets of channels is aligned and bonded to the patterned thick film layer on the second silicon. The bonded first and second wafers are separated into a plurality of printheads 12 by a dicing operation.

Heat sink 40, one for each cartridge 10, has a first surface 47 and a second surface 49 and is formed with alignment holes 43, a recess 52, and a passageway 54. The passageway 54 interconnects an opening 55 in the side of the heat sink with the heat sink recess 52. A printhead 12 is attached to the first surface 47 of the heat sink to complete the printhead assembly 46 by, for example, a suitable adhesive, with the heat sink recess 52 aligned with the heater plate recess 38. The adhesive used to attach the printhead to the heat sink seals the interface between the heater plate and heat sink recesses. The printhead assembly is fixedly attached to the cartridge by inserting the housing stake pins 44 in the heat sink alignment holes 43 and ultrasonically staking the distal ends of the stake pins extending through the heat sink to form fastening heads 45, thereby permanently attaching the printhead assembly to the cartridge with the printhead's channel plate residing against the cartridge. The channel plate is also bonded to the cartridge and a conduit or tubing 56 is positioned and bonded in place to connect the well output port 30 and the heat sink opening 55. The ink path from the cartridge to the printhead nozzles 27 is depicted by arrows 58 and comprises the cartridge well 28, the output port 30, the conduit 56, the heat sink passageway 54 and recess 52, the heater plate recess 38, channel plate reservoir 34 and channels 51. A frame shaped member 60 is surroundingly installed and bonded around the printhead assembly edge containing the nozzles. In FIG. 2, droplets 13 ejected from the nozzles 27 are shown following trajectories 15 for illustrative purposes.

Normally, in a typical edgeshooter type printhead, the ink is supplied to the printhead at the channel plate side via an ink inlet and contacts the heater plate at the side containing the heating elements. Most of the thermal energy which has to be generated for droplet ejection in a thermal ink jet printhead is dissipated in the heat sink and the ejected droplets as waste heat. In the existing edgeshooter type thermal ink jet printers having a printing resolution of 300 spots per inch (spi), up to 25% of the waste heat is carried off by the ink droplets during high duty cycle printing and lesser amounts of heat are removed by the droplets during low duty cycle printing. Since only a relatively small amount of waste heat is dissipated by the ejected ink droplets, the majority of the waste heat is dissipated through the heat sink and printhead, thereby causing them to increase in temperature, which leads to printing defects or printhead failure. One undesirable alternative solution is to add active cooling which causes an increase in printer cost. For this reason, as much as possible of the heat energy should be carried away by the ejected ink droplets. Unfortunately, the portion of waste heat removed by the droplets is sharply reduced with increasing printing resolution because the droplets are smaller as the spots per inch increase; for example, 600 spi versus 300 spi.

The above described printhead assembly 46 enables an increase in heat carried away by the ejected ink droplets by providing increased heat transfer to the ink in the printhead, so that, for a 300 spi printhead, up to 75% of the waste heat is carried off by the ejected droplets during high duty cycle printing. This is enabled by placing the incoming ink into the path of the waste heat flow from the heating elements to the rest of the printhead. As a result, much more waste heat is carried away by the ejected ink droplets because of the increase in droplet temperature, and thus such a printhead configuration will lead to substantially slower temperature rise in the printhead and to a much lower temperature increase over ambient at which the printhead will stabilize during a given duty cycle printing.

With continued reference to FIGS. 1 and 2, the recess 38 is etched into the heater plate 48 on the side opposite to the side having the etch stop layer 36 with the heating elements thereon. The etch stop layer has the ink feeding apertures 37 through the etch stop layer at locations on opposite sided of each array of heating elements and associated addressing electrodes. The heater plate recess 38 is located below and at least partially beneath the array of heating elements for maximum effectiveness of heat transfer. An additional opportunity for heat transfer is available because of the removal of some of the heater plate silicon, and with the removal of the silicon extending under the heating elements, the heat flow path is shortened from the heating elements to the ink in the heater plate recess 38. The etch stop is designed to be as thin as possible, while still being able to support the heating elements during manufacturing. Though an etch stop thickness of 25 to 50 $\mu$m is sufficiently robust to support printhead manufacture, an optionally added underlayer (not shown) of polymeric material, such as, for example, polyimide, between the doped n-type layer 36 and the heating elements with associated addressing electrodes will not only strengthen the second silicon wafers, but the polymeric material has superior thermal properties to that of silicon. As a result, the thermal efficiency of the printhead is increased when silicon is replaced with a polymeric material. A typical thickness of the layer of polymeric material is about 10 to 25 $\mu$m.

Figure 3:
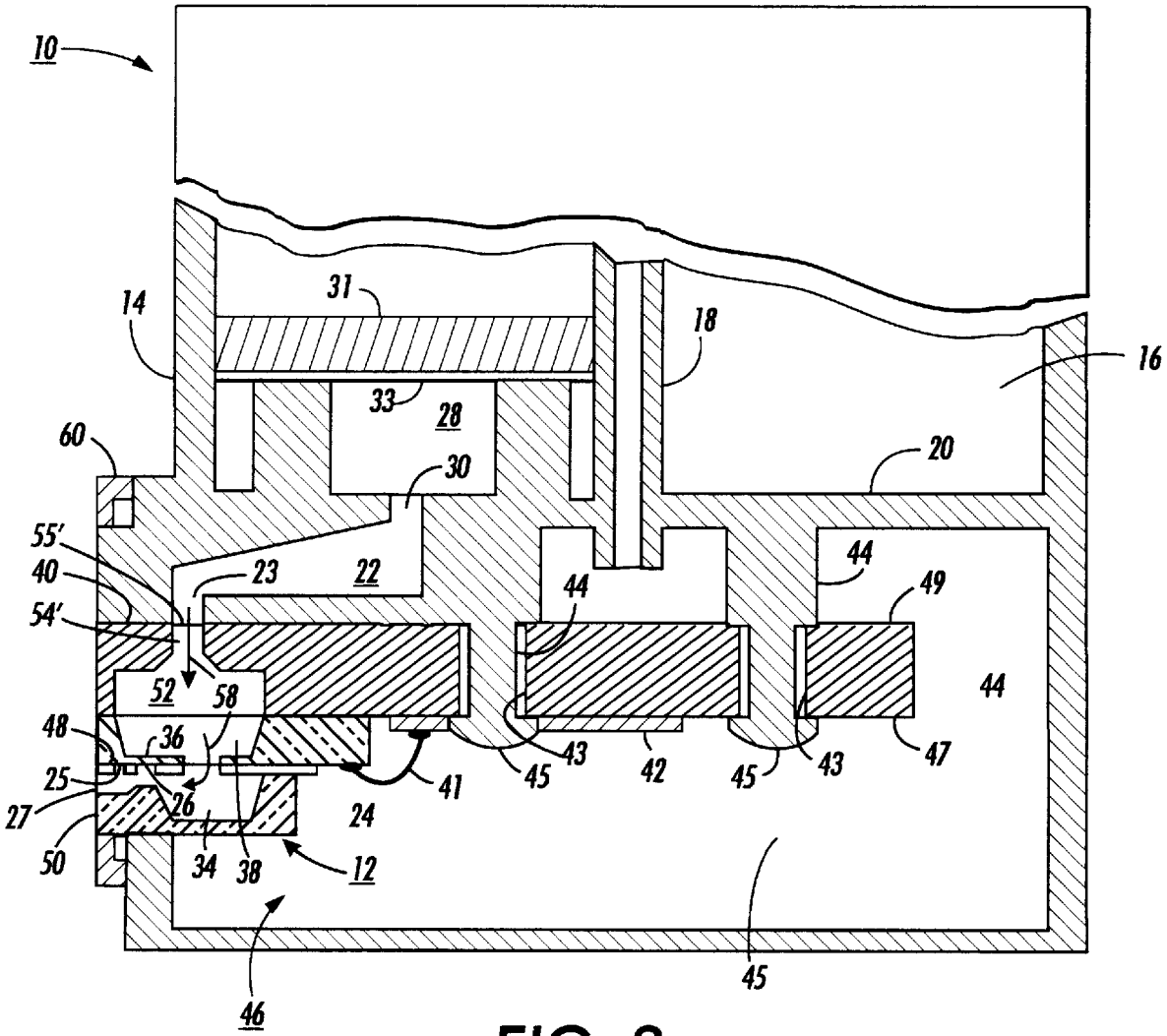
FIG. 3 is a schematic, partially shown and partially sectioned, side elevation view of an alternate embodiment of the ink jet cartridge with integral printhead having the improved heat management of the present invention.
Figure 4:
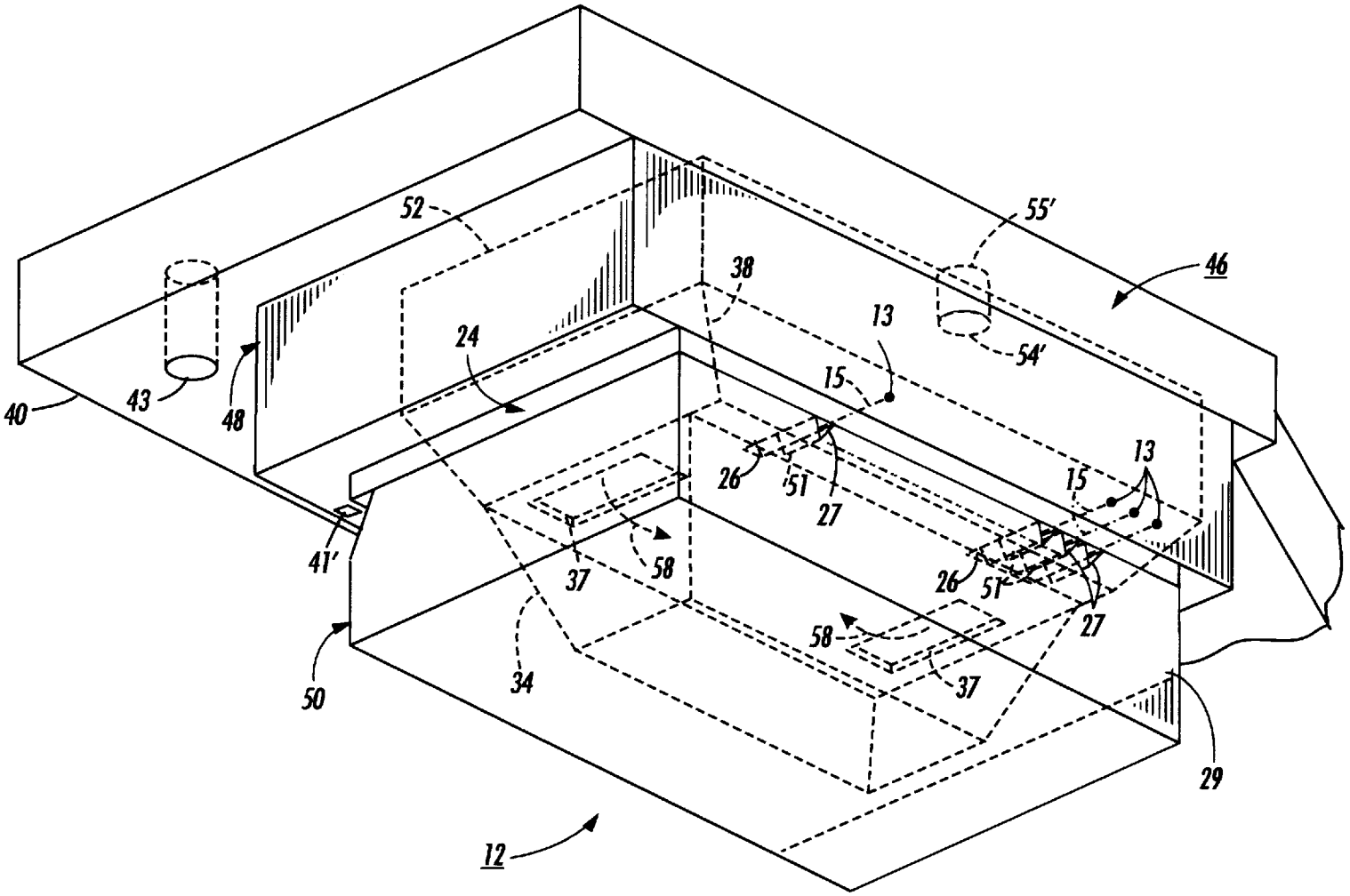
FIG. 4 is a schematic isometric view of the printhead shown in FIG. 3 in which the internal ink flow passageways and reservoirs are shown in dashed line.

An alternate embodiment of the present invention is shown in FIGS. 3 and 4, and are similar to the views shown in FIGS. 1 and 2. The main difference between the two embodiments is that the printhead assembly of FIGS. 3 and 4 is installed on the stake pins 44 with the second surface 49 of the heat sink 40 residing in contact with a portion of the cartridge housing floor 20. This arrangement enables the inlet port 55' for the recess 52 in the heat sink to be located in the heat sink second surface 49 with the printhead oriented upside down relative to the location of FIGS. 1 and 2 on the first surface 47 of the heat sink. The cartridge housing floor 20 contains a transitioning passageway 22 with an outlet 23. The transitioning passageway interconnects the well output port with the inlet port 55' of the heat sink. The passageway outlet 23 is aligned with the heat sink inlet port 55' and the interface between the two are sealed by an adhesive, which also serves to assist in fastening the printhead assembly to the housing 14. This embodiment offers an additional advantage in that the transitioning passageway provides a more vertical ink flow path which enables air bubbles to travel from the channel plate reservoir through the heater plate recess 38, heat sink recess 52, and heat sink passageway 54' and then through the transitioning passageway 22. into the cartridge well 28, where the accumulation of air bubbles has less effect on the ink refill action for the printhead.

Although the foregoing description illustrates the preferred embodiment, other variations are possible and all such variations as will be obvious to one skilled in the art are intended to be included within the scope of this invention as defined by the following claims.

I claim:

1. An ink jet cartridge for use in a thermal ink jet printer having improved heat management, comprising:

a housing having a vented chamber containing ink and an ink outlet port;

a printhead having a channel plate and a heater plate, the channel plate and heater plate each having first and second surfaces, the channel plate first surface having a recess and a plurality of grooves therein having opposing ends, one end of each of the grooves opening through an edge face of the channel plate, and the other end of the grooves being in communication with the channel plate recess, the heater plate first surface having a plurality of heating elements and addressing electrodes thereon, the heater plate second surface having a recess therein with a floor spaced a predetermined distance from the heater plate first surface, the floor having at least one aperture therein which opens through the heater plate first surface at a location adjacent, but spaced from one side of said plurality of heating elements and addressing electrodes, the channel plate and heater plate first surfaces being aligned and bonded together, so that the grooves and groove open ends form printhead ink channels and nozzles, respectively, with each channel having a heating element therein located a predetermined distance from the nozzles, the channel plate recess forming an ink reservoir after being closed by the heater plate, and the aperture in the heater plate floor providing a communication path between the heater plate recess and the reservoir;

a heat sink having first and second surfaces and being fixedly mounted on the housing, the heat sink having an internal cavity opening through the heat sink first surface and an inlet port connected to the cavity;

said printhead being fixedly attached to the heat sink with the heater plate second surface residing against the heat sink first surface and the heater plate recess being aligned with the cavity opening of the heat sink; and means connecting the housing outlet port with the heat sink inlet port, whereby the ink is heated by the heat sink prior to entry into the reservoir, so that ink droplets ejected from said nozzles have increased temperature and thus carry away more waste heat.

2. The cartridge as claimed in claim 1, wherein the distance between the heater plate floor and the heater plate first surface is about 25 to 50 $\mu$m; and wherein the floor of the heater plate recess is partially located beneath and adjacent the heating elements for maximum heat transfer from said heating elements.

3. The cartridge as claimed in claim 1, wherein the second surface of the channel plate resides against the housing; wherein the means for connecting the housing outlet port and the heat sink inlet port is a conduit; and wherein the heat sink has at least one hole through the first and second surfaces of the heat sink and the heat sink is fixedly mounted to the housing by at least one stake pin integrally form on said housing which is inserted though the heat sink hole and staked.

4. The cartridge as claimed in claim 1, wherein the heat sink inlet port is located in the second surface of the heat sink; wherein the heat sink second surface resides against the housing; wherein the means for connecting the housing outlet port and the heat sink inlet port is by aligning and sealing said ports together; and wherein the heat sink has at least one hole through the first and second surfaces of the heat sink and the heat sink is fixedly mounted to the housing by at least one stake pin integrally formed on said housing which is inserted though the heat sink hole and staked.

* * * * *